United States Patent [19]

Dougherty

[11] 4,355,260

[45] Oct. 19, 1982

[54] SHADOW MASK SUSPENSION MEANS FOR COLOR CATHODE RAY PICTURE TUBES

[75] Inventor: Lawrence W. Dougherty, Sleepy Hollow, Ill.

[73] Assignee: Zenith Radio Corporation, Glenview, Ill.

[21] Appl. No.: 167,990

[22] Filed: Jul. 14, 1980

[51] Int. Cl.[3] ..... H01J 29/07; H01J 9/18

[52] U.S. Cl. ..... 313/404; 29/25.15; 29/25.19; 313/406

[58] Field of Search ..... 313/406, 407, 404; 29/25.14, 25.15, 25.19

[56] References Cited

U.S. PATENT DOCUMENTS

| | | | |
|---|---|---|---|
| 3,999,098 | 12/1976 | Dougherty | 313/407 |
| 4,019,231 | 4/1977 | Dougherty | 29/25.15 |
| 4,100,451 | 7/1978 | Palac | 313/404 |
| 4,300,071 | 11/1981 | Dougherty et al. | 313/407 |
| 4,317,064 | 2/1982 | Dougherty | 313/406 |

*Primary Examiner*—Palmer C. Demeo

*Attorney, Agent, or Firm*—Ralph E. Clarke, Jr.

[57] ABSTRACT

Apparatus is disclosed for assembling a frameless, relatively thin and torsionally flexible shadow mask and four relatively thick and inflexible mask-suspension brackets. The apparatus, which is for use in the manufacture of color television cathode ray picture tubes, provides for conforming of the brackets to the contour of the skirt of the mask, and the welding of the brackets thereto. The brackets according to the invention have a planar central section and two arms for the embracing of and attachment to the skirt around the corners of the mask. Each bracket has at least one region in each arm adjacent to the central section that is perforated to decrease the cross-sectional area of the region and thus increase electrical resistance of the region. When an electrical current is applied through the bracket, the magnitude of the current and the reduction in cross-sectional area of the region is effective to selectively resistively heat the region to a plastic state whereby the bracket can be conformed to the desired contour of the mask without spring-back and without the deforming the mask. The method according to the invention provides for conforming the contour of the bracket to the contour of the mask.

7 Claims, 10 Drawing Figures

SHADOW MASK SUSPENSION MEANS FOR COLOR CATHODE RAY PICTURE TUBES

CROSS REFERENCE TO RELATED APPLICATIONS

This application is related to, but in no way dependent upon copending applications Ser. No. 024,272 filed Mar. 26, 1979; Ser. No. 084,708 filed Oct. 15, 1979, now U.S. Pat. No. 4,317,064; Ser. No. 101,959 filed Dec. 10, 1979, now U.S. Pat. No. 4,300,071; and Ser. No. 144,719 filed Apr. 28, 1980, all of common ownership herewith.

BACKGROUND OF THE INVENTION AND PRIOR ART DISCLOSURES

This invention relates to color cathode ray tubes of the type having a four-corner suspended frameless shadow mask, and is especially concerned with proper suspension of the mask.

The conventional color selection electrode or "shadow mask" comprises a dished apertured mask which is welded to a rigid frame that imparts the necessary rigidity to the dished section. This type of mask-frame assembly is mounted in close adjacency to the faceplate of the cathode ray tube by a suspension system comprising three or four leaf springs. The springs are welded to the frame at selected points around the periphery. Because of the weight of the mask, it is necessary that the springs be relatively stiff; this stiffness results in the application of a load directed radially inwardly of up to four or five pounds to the mask-frame assembly. The distal ends of the springs are apertured to engage studs which project inwardly from the rearwardly extending flange of the tube faceplate. It is necessary that the mask-frame assembly be capable of being demounted and remounted with exact precision in relation to the faceplate several times; this demounting and mounting is required in the manufacturing process. Demounting is accomplished by depressing the springs to disengage the studs, and separating mask from panel usually by automatic machinery. In remounting, the shadow mask and the faceplate are brought into propinquity whereby the springs are caused to re-engage the studs.

The type of mask described; that is, one having a heavy, rigid frame which in turn provides the necessary rigidity to the dished, apertured mask, has significant disadvantages despite its proved commercial viability. The disadvantages include costliness, excessive mass, heavy weight, and the tendency to distort upon heating under the impact of the cathode ray tube electron beams. As a result of this distortion, it has been necessary to design elaborate and costly shadow mask suspension systems wherein bimetallic components provide the necessary "Q-spacing" to compensate for such heating. Q-spacing is defined as the required spacing between the shadow mask and the phosphor screen. The Q-spacing must be accurately maintained for proper registration of mask apertures with the associated phosphor stripes (or dots).

The problems inherent in a rigid mask design as described has led to the invention of a low cost, lightweight, non-self-rigid, torsionally flexible shadow mask, preferably of one-piece, frameless construction. A shadow mask of this type is disclosed in U.S. Pat. No. 4,100,451 to Palac, of common ownership herewith, wherein an approximately rectangular, flangeless curved faceplate supports on a concave inner surface thereof in a central region a phosphor screen comprising patterns of red-, blue-, and green-emissive phosphor triads. The low-mass, approximately retangular, non-self-rigid, torsionally flexible shadow mask has a central portion with the patterns of electron-transmissive apertures in registry with the patterns of phosphor triads. The mask has a rim portion providing substantial rigidity with respect to axes normal to the sides thereof, while providing for flexure of the mask with respect to its diagonals. The mask suspension system establishes a predetermined position of the mask relative to, and at a predetermined spacing from, the inner surface of the faceplate. The system includes four suspension means for mechanically coupling the mask directly to the corner portions of the faceplate. The suspension means are located one at each corner of the mask to permit the mask to flex about its diagonals and conform to the contour of the faceplate despite any twist-wise deformation thereof. By this means, the predetermined spacing between the mask and the faceplate inner surface is maintained.

A plan view of a shadow mask-face panel assembly wherein the mask is of the frameless type is shown by FIG. 1. The assembly 10 comprises a substantially rectangular shadow mask 12 having a dished perforate central section 14. Included in the assembly is a face panel 16 having a rearwardly extending flange 18.

Four identical suspension devices 20 provide for rigidly and stably suspending mask 12 in proper spatial relationship to the dished central section of face panel 16. As shown, one such device is located at each corner of the face panel 16 to provide for four-corner mounting of the shadow mask 12. This configuration is disclosed in the referent copending applications Ser. Nos. 024,272; 084,708; 101,959; and 144,719 and in referent U.S. Pat. Nos. 4,300,071 and 4,317,064. In consequence of the four-corner mounting system, the mask, which is low in cost but inherently lacking in self-rigidity due to its one-piece, frameless construction, is suspended with high rigidity derived from the rigidity of the glass face panel 16. The suspension system furnishes a mechanically rigid link between the flange of the face panel and the mask, yet permits the mask to be conveniently and repeatably demounted and precisely remounted with respect to the face panel.

Four studs 24 are shown as being affixed to the flange 18 of the face panel 16 on the associated diagonals 28 and 30. The studs 24 are arranged to extend substantially radially inwardly on diagonals 28 and 30 and indicated. Leaf springs 32 provide for detachably interconnecting the corners of mask 12 to the studs 24 extending from the flange 18 of the face panel 16. Each leaf spring is apertured for engagement with the associated tapered stud 24.

FIG. 2 shows in detail one of four corner sections of the face panel 16 and the rearwardly extending flange 18. Mask 12 has a rearwardly extending skirt 34 and an integral rim which extends radially outwardly. The mask suspension device 20 (notable as being one of four identical devices) comprises a stud 24 affixed to the face panel flange 18, and a leaf spring 32 for detachably interconnecting the corner of mask 12 shown to stud 24. Means for mounting spring 32 on mask 12 is shown in this embodiment as comprising a bracket 36 having two arms 38 and 40 for attachment to mask 12 and spring 32. Spring 32 is mounted on mask diagonal 30 and normal to the diagonal such that spring 32 extends rearwardly away from the dished central section of face panel 16. When spring 32 is deflected, its distal end 47 travels in an arc inwardly toward the faceplate center axis, all as disclosed and claimed in referent U.S. Pat. No. 4,300,071.

Because of the lack of the frame in a mask of the type described, the attachment of the springs 32 to the mask is by means of the relatively stiff brackets 36 which embrace the mask 12, and to which the mask 12 is welded. The suspension springs 32 in turn are welded to suitable areas of the brackets 36. The pressure exerted by the springs when the mask is in the mounted position, and when the mask is demounted and remounted, is redistributed to the mask by the brackets so that the non-self rigid mask is not distorted. The suspension system is designed to precisely fix and hold the predetermined spatial position of the mask as a whole relative to the faceplate against translational or rotational displacement, this in spite of any thermal expansion or contraction of the mask, frictional restraint during demounting and remounting, mechanical shocks, or force of gravity.

With reference again to FIG. 2, the bracket 36, shown as having two arms 38 and 40 for embracing the rearwardly extending skirt 34 of mask 12, is preferably comprised of cold-rolled steel having a thickness of about 60 mils. The bracket may be formed by well-known means such as stamping, coining, bending, shearing, punching, or piercing, etc. The bracket 36 is preferably welded to the skirt 34 of mask 12 by spot welding, indicated by weld points 44 in each of the arms 38 and 40.

The material of which the frameless mask 12 and the unitary skirt 34 to which the bracket 36 is welded, typically comprises a mild steel having a thickness of about six mils. In consequence, mask 12 is highly susceptible and yielding to distortive forces such as may originate in the mask suspension means. As has been noted, the brackets provide for redistributing the pressures exerted by the suspension springs.

The bracket themselves however may be a source of mask distortion. Any steel fabricating process, such as the stamping process by which the brackets may be shaped, is inherently incapable of producing an exact contour replica of a master in every piece formed. As a result, if one or more of the four brackets used for suspending the mask deviates appreciably from the desired contour, the thin, relatively flexible shadow mask, which is only about one-tenth the thickness of the bracket, will deform to conform to the contour of the thick, relatively inflexible bracket. Thermal processing of the cathode ray tube after the face-panel has been screened, such as heating the tube for frit sealing, will distort the mask by relieving the stress, and the mask apertures will be out of registry with the associated phosphor elements.

In U.S. Pat. No. 3,999,098 to Dougherty, assigned to the assignee of the present invention, there is disclosed means for suspending a frameless, torsionally flexible shadow mask in adjacency to a flangeless faceplate. The bracket includes a pair of diverging arms. The arms have wings bent out of the plane of the arms. The wings have provision for radial yield before welding, the provision indicated as being thinned-down sections. The wings are slightly overbent inwardly, and are allowed to "give" when the bracket is fixed on the mask. The thinned-down sections are intended to provide a low-force yield point for accommodation of manufacturing tolerances. It has been discovered, however, that the mounting geometry inherent in such a design is lacking in strength due to "puckering" of the mask material and subsequent permanent deformation as a result of application of certain forces to the bracket during normal production handling.

OBJECTS OF THE INVENTION

It is a general object of the invention to provide for improving the suspension of a shadow mask in a color cathode ray picture tube.

It is a less general object to provide for improving the suspension of a relatively thin, torsionally flexible shadow mask with a skirt in precise adjacency to a face panel having a rearwardly extending flange.

It is a more specific object of the invention to provide for the suspension of a relatively thin, torsionally flexible shadow mask by suspension means including a relatively thick, inflexible bracket;

It is a specific object of the invention to provide for conforming relatively thick, inflexible suspension brackets to the contours of a relatively thin, torsionally flexible shadow mask without deforming the mask.

BRIEF DESCRIPTION OF THE DRAWINGS

The features of the present invention which are believed to be novel are set forth with particularity in the appended claims. The invention together with further objects and advantages thereof may best be understood by reference to the following description, taken in conjunction with the accompanying drawings in the several figures of which like reference numerals identify like elements, and in which:

DESCRIPTION OF THE PREFERRED EMBODIMENTS

Figure 1:
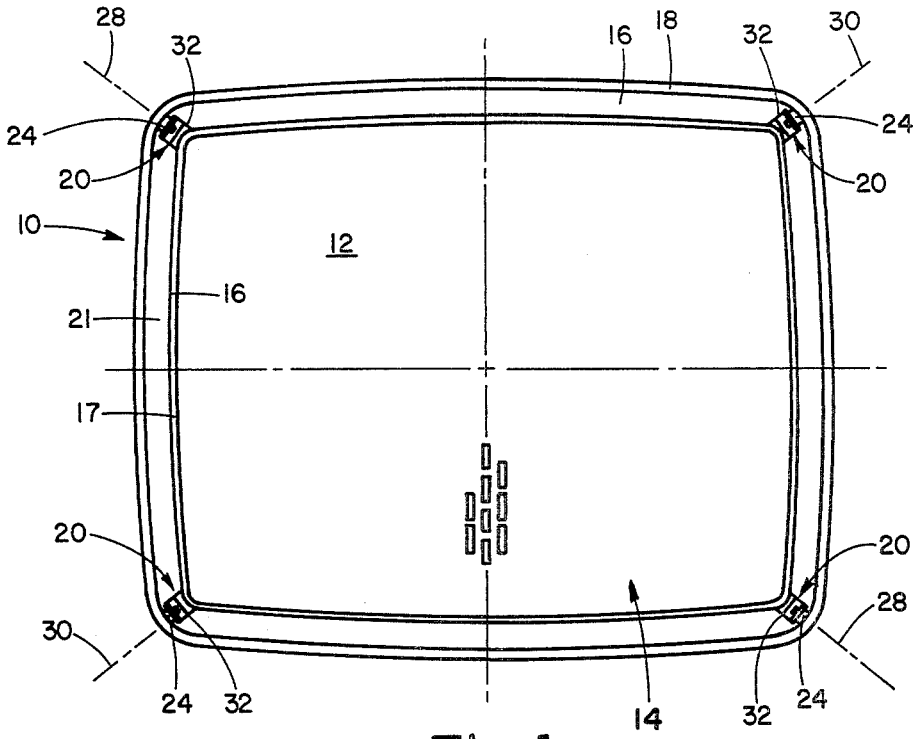
FIG. 1 is a plan view of a face-panel shadow-mask assembly showing a novel corner mask suspension system according to the invention disclosed in referent copending application Ser. No. 101,959.
Figure 2:
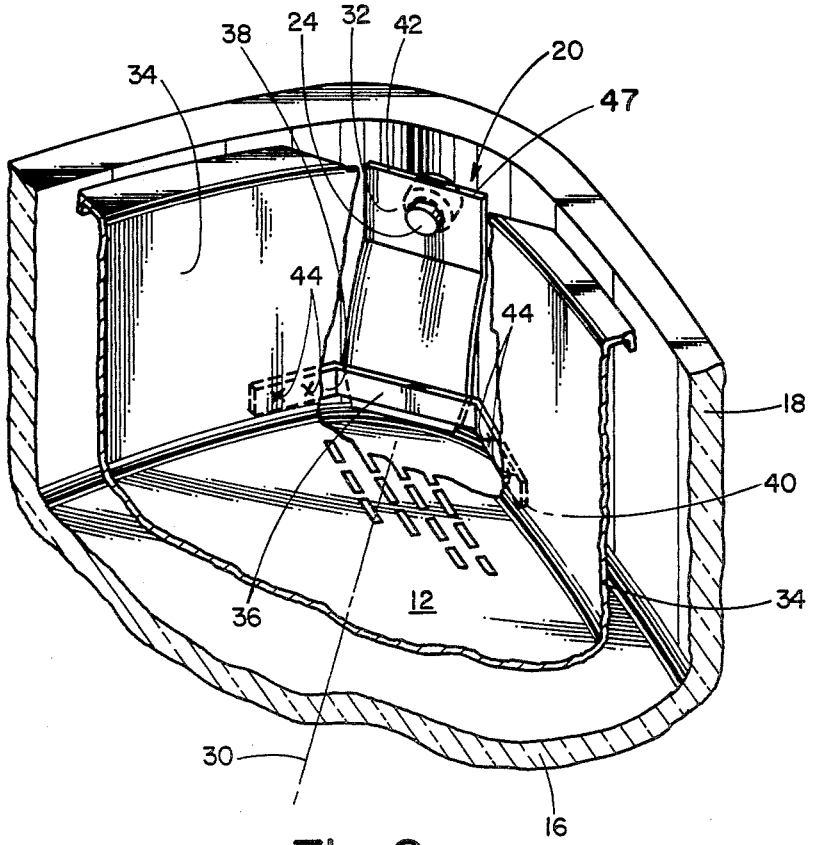
FIG. 2 is an oblique view in perspective of a corner of a face panel with the shadow mask partially cut-away to show details of an embodiment of the corner mask suspension system according to the reference '959 application.
Figure 3:
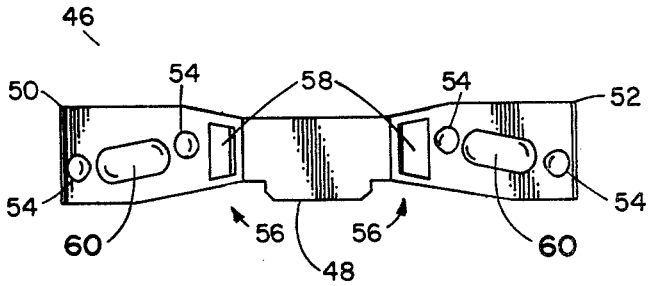
FIG. 3 is a plan view of a preferred embodiment of a bracket according to the invention.

FIG. 3 depicts a metallic bracket 46 according to the invention which is a part of a suspension means for a metallic shadow mask for use in a color cathode ray picture tube. The shadow mask has a rearwardly extending skirt and is mounted in precise adjacency to a substantially rectangular face panel by form corner-mounted suspension means; bracket 46 is a part of one such suspension means. The shadow mask is of the frameless type, and is relatively thin and torsionally flexible, while bracket 46 is relatively thick and inflexible.

Bracket 46, which may be of bow-tie-shape as shown, has a planar central section 48 and a pair of arms 50 and 52 for the embracing of and attachment to an associated corner of the mask. Bracket 46 further includes spaced-apart welding projections 54. There may be at least two such projections 54 on each arm 50 and 52; the number shown by way of example on bracket 46 is two projections, or a pair on each arm. Bracket 46 may also have embossments 60 extending between welding projections 54 as shown for strengthening and stiffening arms 50 and 52.

The bracket 46 according to the invention is characterized by having a region 56 in each arm 50 and 52 adjacent to planar central section 48 which is reduced in cross-sectional area for increasing the electrical resistance of regions 56. Each region 56 is shown as being reduced in cross-sectional area by virtue of at least one perforation 58 therethrough, shown by way of example as being one substantially rectangular perforation in each arm.

When electrical current is routed through bracket 46 according to the invention, the magnitude of the current and the reduction in cross-sectional area in regions 56 is effective to selectively resistively heat regions 56 to a plastic state. As a result, bracket 46 can be conformed to the desired contour of the mask without spring-back, and without deforming the mask. The resistance R of the regions 56 of reduced cross-sectional area to electrical current is according to the classic formula $$R=(PL)/A$$

where rho is the resistivity of the material, L is the length of the region, and A is the area of the region.

Figure 3A:
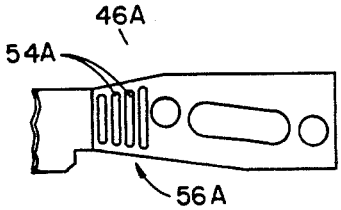
FIGS. 3A and 3B show structural variations of the FIG. 3 embodiment.
Figure 3B:
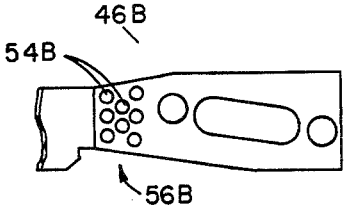

The perforations 58 in regions 56 of bracket 46, shown as a preferred embodiment comprising substantially rectangular perforations, may consist of perforations of other shapes, as shown by way of example in FIGS. 3A and 3B. In FIG. 3A, perforation 54A in region 56A of bracket 46A is depicted by way of example as comprising a series of vertical slots; the perforations may as well be horizontally oriented slots. FIG. 3B shows the perforation 54B in region 56B of bracket 46B as consisting of a series of holes. Whatever the configuration of the perforation, the resistance is determined by the formula set forth supra.

Figure 4:
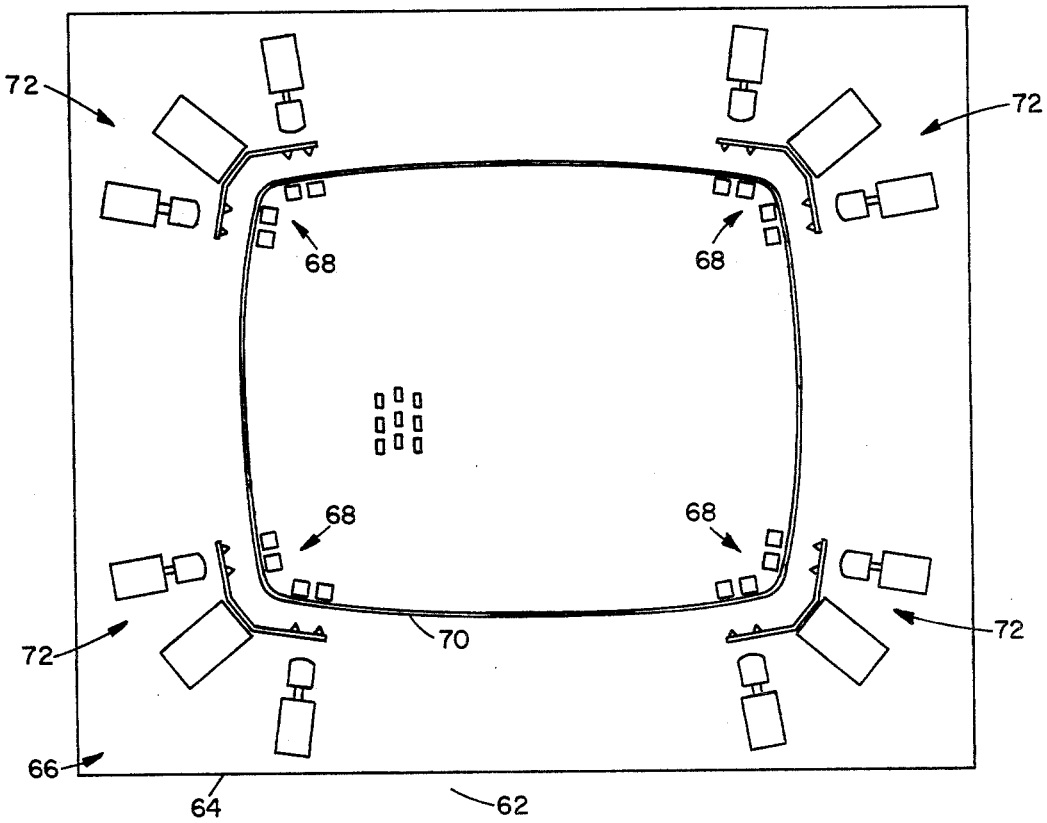
FIG. 4 is a plan view of an apparatus according to the invention for assembling a shadow mask and four corner-mounted mask-suspension brackets.

An apparatus for assembling a frameless shadow mask and four brackets according to the foregoing description is valuable for use in the manufacture of color cathode ray picture tubes having such components. The apparatus 62, depicted schematically by FIG. 4, comprises the following parts. Table means 64 has an electrically insulated surface 66, which may comprise and adherent insulative plastic sheet, for example. Table means 66 includes positioning means 68 for receiving and positioning the frameless shadow mask 70; the part of the mask depicted is the inwardly extending skirt. Four bracket-conforming and attachment means 72, alike in form and function, are located at each corner of mask 70 as positioned on table 64. It is to be noted that positioning means 68 heretofore referred to are also part of the bracket-conforming and attachment means 72. The components of the bracket conforming and attachment means 72 are electrically discrete; that is, insulated from table means 64, from mask 70, and from each other. The purpose of the insulative status will be explained.

A more detailed view of one of the four bracket conforming and attachment means 72 of apparatus 62 is depicted diagrammatically in FIG. 5; the components described in the following paragraphs are included in means 72.

Means 74 provide for clamping and holding the planar central section of bracket 78 and moving bracket 78 inwardly so that the welding projections 80 and 81 may make contact with skirt 82 of mask 70. Full contact of the weld projections is not made in all cases because individual brackets may deviate considerably from the desired configuration. For example, a bracket may be so out-of-true that only one of a pair of welding projections on an arm makes contact with the skirt, and the projection maybe either the one nearest the central section or farthest from the central section. The conformance of such out-of-true brackets to the masks skirt is accomplished by the means and method according to the invention.

Figure 5A:
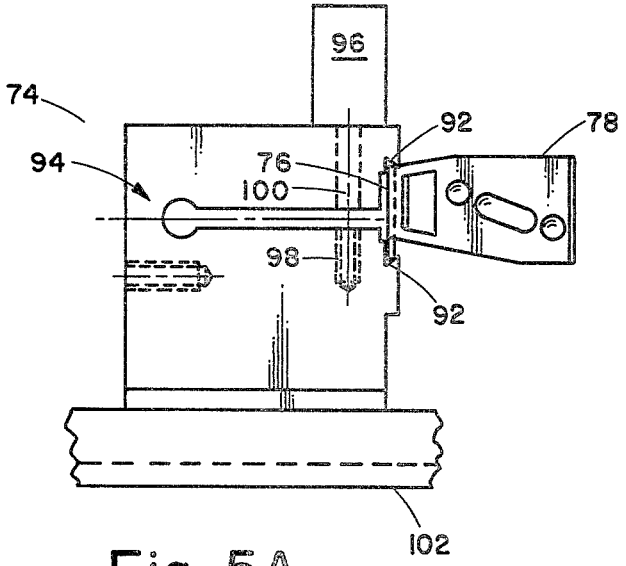
FIGS. 5 and 5A are detail views of a corner section of the apparatus shown in FIG. 4.
Figure 5:
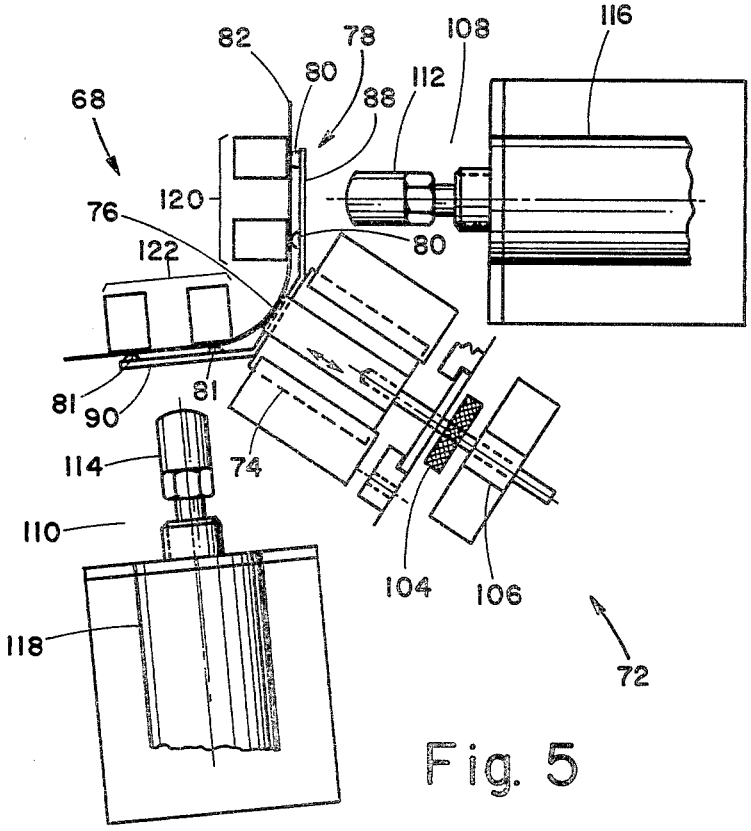

Means 74 are depicted in greater detail in FIG. 5A wherein the planar central section 76 of bracket 78 is shown as being clamped by jaws 92. Jaws 92, which pivot from point 94, are caused to close and open by compression means 96, indicated schematically, which may for example comprise a reversible gear motor assembly. The rotating of a gear motor assembly causes the threads 98 of screw means 100 to compress (or release) the material of means 74 to close or open jaws 92. Alternately, compressive means 96 cold as well comprise a pneumatic cylinder. The movement inwardly (and outwardly) of bracket 78 is made possible by V-groove slide means 102, wherein means 74 may be propelled by a pneumatic cylinder. Bracket 78 may be loaded by hand by the operator of apparatus 72. Knurled adjustment screw 104, depicted in FIG. 5, and associated thrust block 106, provide for adjustment of the excursion of means 74 in moving bracket 78 inwardly.

Ram means 108 and 110 provide for exerting inward pressure on arms 88 and 90, respectively. The contacting surfaces of ram heads 112 and 114 are formed as a segment of a cylinder as indicated so that pressure ram is exerted on arms 88 and 90 between the pairs of welding projections 80 and 81 to force the bracket and projections toward the skirt. Ram means 108 and 110 exert pressure by means indicated as being pneumatic cylinders 116 and 118 respectively.

Positioning means 68 comprises two pairs of mask-supporting means 120 and 122, with each pair indicated by a bracket. Mask-supporting means 120 and 122 provide for supporting the inner surface of skirt 82. It will be observed that each pair of mask supporting means 120 and 122 match in location an associated pair of welding projections 80 and 81. The mask supporting means provide for supporting skirt 82 against inward deformation from the pressure of ram means 110 and 112, and act as electrical contacts for the welding of the projections to the mask skirt 82.

It is to be noted that due to the forming means for the shadow mask 70, the mask contour is accurate and highly consistent as to form, especially with regard to the peripheral dimensions of the integral skirt 82. This contour accuracy makes possible the utilization of fixed-position mask-supporting means 120 and 122 which also serve as welding electrodes while concurrently providing peripheral locating means for the mask skirt.

Figure 6:
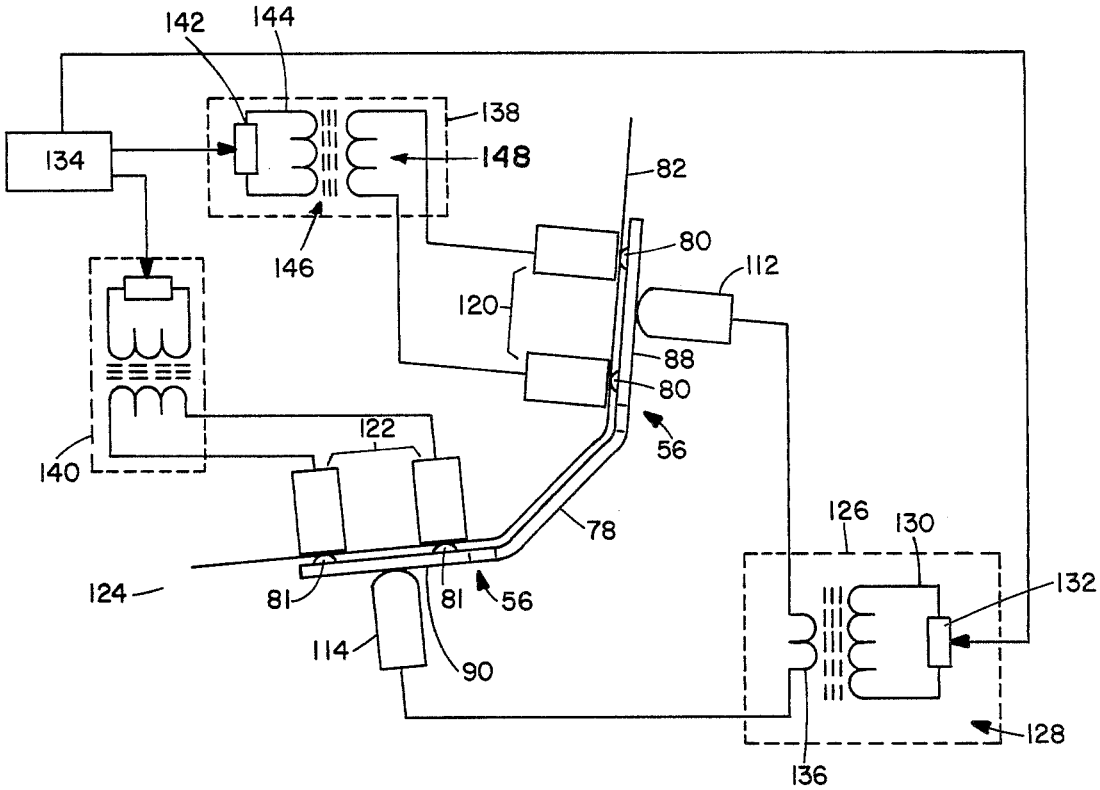
FIG. 6 is a schematic diagram of electrical circuit means used in conjunction with the apparatus according to the invention; and, FIG. 7 indicates graphically the sequence of application of electrical currents for bracket conforming and welding according to the invention.

With reference now to FIG. 6, electric circuit means 124, shown in schematic diagram form, is provided for each of the bracket corner-conforming and attachment means 72. It will be noted that three totally independent paths are provided. Electric circuit means 124 includes bracket current supply means 126, which includes in turn a transformer 128 which is a magnetic-core, step-down unit that provides a flow of current through bracket 78. The primary winding 130 is shown as being connected to a control means 132 which may comprise a switch for introducing a voltage from an external source into primary winding 134 to energize transformer 128, which may comprise a standard spot-welding transformer. Control means 132 is indicated as being activated in turn by a timing and trigger control means 134 which provides for initiating application and controlling the sequence and application of the current from bracket current supply means 126. The legs of secondary winding 136 of transformer 128 are shown as being connected to ram heads 112 and 114 which, when in contact with bracket 78, provide for a series flow of current through bracket 78. When the current is applied through bracket 78 by the way of the ram means 110 and 112, the regions 56 of reduced cross-sectional area of arms 88 and 90 are caused to be selectively resistively heated to a plastic state. The bracket weld projections 80 and 81, under the influence of rams 112 and 114, then move to full contact with the mask skirt with negligible stressing of the bracket. This action provides for the desired bracket-to-mask conformity and concurrently allows the rams to provide the necessary pressure between weld projections and the mask skirt for subsequent resistance welding.

It is to be noted that some current will flow through the mask 70 as well as through the bracket 78. The mask is relatively thin in comparison to the bracket, however, so its greater electrical resistance will limit current flow so only negligible heating of the mask will take place. It is considered desirable to insulate the surface of table means 64 to provide for electrical isolation of mask 70, and thereby eliminate additional current shunting through the structure of the apparatus. The insulation of the surface of table means 64 is indicated by reference number 66 in FIG. 4.

It is also to be noted that to affect the desired current flow through the bracket, it is necessary to provide only a modicum of force between the associated rams and the bracket for adequate electrical contact. Examination of the resulting electrical circuit will reveal that contact or non-contact of the weld projections against the mask skirt is irrelevant to the heating action of the circuit.

Electrical circuit means 124 also includes welding current supply means 138 and 140 for welding arms 88 and 90 on bracket 78 to skirt 82 of mask 70. Welding current supply means 138 and 140 are shown as being connected to mask-supporting means 120 and 122, respectively, for providing a flow of welding current through each of the respective arms 88 and 90. With reference to welding current supply means 138, the welding of arm 80 of bracket 78 to mask skirt 82 is accomplished as follows. Control means 142 may comprise a switch for introducing voltage from an external supply to the primary 144 of transformer 146, which may comprise a standard spot-welding transformer. Control means 142 is in turn activated by timing and trigger control means 134, as described in connection with control means 132. The legs of the secondary winding 148 are shown as being connected to the pair of mask supporting means 120 to supply a series flow of welding current through arm 88.

The operation of welding current supply means 140 in providing current for welding arm 90 to mask skirt 82 is identical to that of means 138.

The method according to the invention for welding bracket 78 to mask skirt 82 is as follows. The projections 80 and 81 are forced towards skirt 82 by respective ram means 108 and 110. An electrical current is routed through bracket 78 by bracket current supply means 126 to selectively resistively heat regions 56 to cause said regions to become plastic. Projections 80 and 81 then make contact with skirt 82 and are welded to skirt 82 by the welding current supply means 138 and 140. The bracket current is removed, allowing regions 56 to cool and become rigid. The result is that as the bracket current is applied through bracket 78 by means 108 and 110, the magnitude of the current is effective to resistively heat the regions 56 of reduced cross-sectional area to a plastic state as the arms 80 and 81 are caused to be welded to the mask skirt 82. Thus the brackets are conformed without spring-back by the pressure of said ram means to the contours of mask without exerting distortive pressure on the mask due to spring-back upon removal of clamping forces and the desired location of the bracket spring mounting surface is maintained by the final rigidity of the bracket upon cooling.

The geometry of the mounting means according to the invention provides for the accommodation of forces on the mask which result from handling of the mask during manufacture. Such forces, which may result from bumping or dropping, for example, are primarily in shear exerted on the relatively thin mask material. The effectiveness of this accommodation significantly increases the strength of the mounting and resolves the problem of "puckering" described in connection with the referent '098 Patent which, as noted, provides for the selective weakening of the wings of the bracket.

The means and method according to the invention have acquired greater significance as a result of the elimination of the "thermal compaction process." This process entailed a separate manufacturing step wherein the unevacuated and unscreened tube envelope was heated to an elevated temperature. The purpose of the process was to relieve the stress in the glass of the face panel. The process was eliminated as a result of intensive effort dedicated to the saving of energy. However, a highly beneficial side effect was lost in that the process provided for the relief of stress in the mask suspension means. While some undesired movement of the mask assembly took place during the process, the stress at least had been relieved prior to the frit and exhaust thermal cycles, wherein any mask movement is much more degrading with regard to performance because displacement of the mask at this stage of manufacture results in mis-landing of the beams relative to the previously applied screen.

Figure 7:
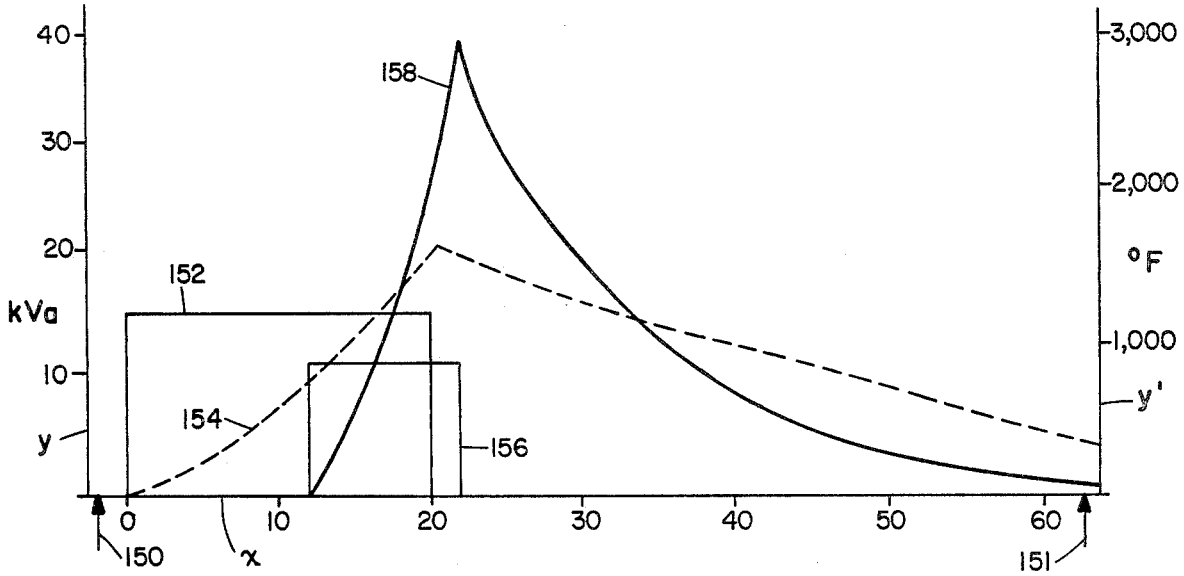

FIG. 7 indicates graphically the results of the action of the timing and trigger control means 134 in initiating the application and controlling the sequence of application of the current from the bracket-current supply means 126, and welding current supply means 138 and 140. The x-axis is scaled in cycles of current application from a 60 Hz power supply. The y-axis is scaled in kilovolt-amperes, and the y'-axis in approximate degrees Farenheit. Arrow 150 indicates a point in time in which ram means 108 and 110 exert inward pressure on mask skirt 82 through the arms 88 and 90 of bracket 78;

that is, a short time before bracket-current supply means 126 is activated. Pulse wave form 152 indicates the magnitude and duration of the current from bracket-current supply means 126; that is, about 15 kVa for twenty-two cycles. Curve 154 indicates the approximate temperature of the regions 56 of reduced cross-sectional area as a result of the selectively resistive heating according to the invention. It will be noted that a temperature of about 1,700 Farenheit will produce the desired plastic state in regions 56 so that the bracket 78 may be conformed to the contour of the mask skirt without spring-back and without exerting distortive pressure on the mask.

Pulse wave form 156 indicates the magnitude and duration of the currents provided by the welding current supply means 138 and 140, indicated by way of example as being about twelve kVa for ten cycles. The temperature of the weld points; i.e., between welding projections 80 and 81 and the associated respective mask supporting means 100 and 122, will be seen by curve 158 to peak at a temperature of about 3,000 F shortly after the peak of curve 154. It is desirable that there be a minimum of "overlap" of the plastic state and the welding operation. Ideally, welding is accomplished within a few milliseconds of reaching the plastic state as indicated by FIG. 7. The temperature of bracket 78 quickly decreases as indicated to a final rigidity upon cooling.

With reference again to FIG. 3, it is important that the regions of reduced cross-sectional area, shown as comprising substantially rectangular perforations, be symmetrical; that is, that regions 56 be substantially identical in cross-sectional area. Any significant variance in cross-sectional area can result in a differential in selective heating, with the result that one of the arms will be relatively inflexible when the welding protrusions are forced against the mask. In consequence, the mask may be deformed or otherwise stressed due to the subsequent spring-back. The same precaution applies to forming the perforations 54A and 54B depicted by FIGS. 3A and 3B, respectively.

Reference to FIG. 7 will show that the conforming of a bracket to the mask, and welding the bracket to the mask, requires less than one second. The duration of the operation is indicated by arrows 150 and 151, in which arrow 150 indicates the point in time in which ram means force the protrusions of the bracket arms toward the mask skirt, and arrow 151 indicates the withdrawal of the ram means. As a result, the desired location of the bracket spring mounting surface is maintained by the final rigidity of the bracket upon cooling.

While particular embodiments of the invention have been shown and described, it will be apparent to those skilled in the art that changes and modifications may be made without departing from the invention in its broader aspects, and therefore, the aim of the appended claims is to cover all such changes and modifications as fall within the true spirit and scope of the invention.

I claim:

1. For use in the manufacture of color television cathode ray picture tubes, an apparatus for assembling a frameless, relatively thin and torsionally flexible, substantially rectangular metallic shadow mask with a rearwardly extending skirt, and four relatively thick and inflexible mask-suspension brackets, each bracket having a planar central section and two arms for the embracing of and attachment of said skirt around a corner of said mask, said bracket having at least one region in each arm adjacent to said central section with decreased cross-sectional area and thus increased electrical resistance, said apparatus providing for the conforming of said brackets to the desired contour of said skirt, and the welding of the brackets thereto, the apparatus comprising;

table means having an electrically insulated surface including positioning means for receiving and positioning said mask on said table;

bracket conforming and attachment means located at each of said corners, the components of said means being electrically discrete each of said means including:

means for clamping said planar central section of said bracket and moving said bracket inwardly so that said arms make at least partial contact with said skirt;

ram means for exerting inward pressure on each arm;

mask-supporting means for supporting the inner surface of said skirt against inward deformation from the pressure of said ram means;

electrical circuit means for each of said bracket corner-conforming and attachment means including bracket current supply means connected to said bracket through said ram means for providing a flow of current through said bracket;

electrical welding means for welding said arms to said skirt;

electrical control means for initiating application and controlling the sequence of application of said bracket current supply means and said welding means;

such that said bracket current is applied through said bracket by way of said ram means, and the magnitude of said current is effective to selectively resistively heat said regions of reduced cross-sectional area to a plastic state as said arms are cause to be welded to said mask skirt, whereby said brackets are conformed without spring-back by the pressure of said ram means to the contour of said mask without exerting distortive pressure on said mask.

2. For use in the manufacture of color cathode ray picture tubes, an apparatus for assembling a frameless, relatively thin and torsionally flexible, substantially rectangular metallic shadow mask with a rearwardly extending skirt, and four relatively thick and inflexible mask-suspension brackets, each bracket having a planar central section and two arms for the embracing of and attachment to said skirt around a corner of said mask, said bracket having at least one region in each arm adjacent to said central section that is perforated to decrease the cross-sectional area of the region and thus increase electrical resistance of the region, said bracket further including a pair of spaced-apart welding projections on each arm, said apparatus providing for the conforming of said brackets to the contours of said mask without spring-back, and the welding of the brackets to the skirt, the apparatus comprising:

table means having an electrically insulating surface including positioning means for receiving and positioning said mask on said table;

bracket conforming an attachment means located at each corner of said mask, the components of said means being electrically discrete, each of said means including:

means for grasping and holding said planar central section of said bracket and moving said bracket inwardly so that said welding projections are contiguous to said skirt;

ram means for exerting inward pressure on each arm between said pairs of welding projections;

two pairs of mask-supporting means for supporting the inner surface of said skirt, one of each pair matching in location an associated pair of said welding projections, said means supporting said skirt against inward deformation from the pressure of said ram means;

electrical circuit means for each of said bracket conforming and attachment means including:

bracket current supply means connected to said bracket through said ram means for providing a flow of current through said bracket;

welding current supply means connected to each of said pairs of mask supporting means for providing a flow of welding current through each of said arms between the associated pairs of welding projections;

timing and trigger control means for initiating application and controlling the sequence of application of said bracket current supply means and said welding current supply means;

such that said bracket current is applied through said brackets by way of said ram means to cause said regions of reduced cross sectional area of said arms to be selectively resistively heated to a plastic state, and said welding current is applied by way of said mask supporting means to cause said welding projections of said arms to be welded to said mask skirt, whereby said brackets are conformed without spring-back by the pressure of said ram means to the desired contour of said mask without exerting distortive pressure on said mask.

3. In a color cathode ray picture tube having a rectangular face panel and a substantially frameless relatively thin and torsionally flexible metallic shadow mask mounted in precise adjacency to said panel by corner-mounted suspension means, each suspension means including a relatively thick and inflexible metallic bracket having a planar central section and a pair of arms for the embracing of and attachment to an associated corner of said mask, said bracket further including at least two spaced-apart welding projections on each arm, said bracket being characterized by having a substantially rectangular perforated region in each arm adjacent to said central section which provides a reduction in cross-sectional area for increasing electrical resistance of said regions, such that when electrical current is routed through said bracket, the magnitude of said current and the reduction in cross-sectional area in said regions is effective to selectively resistively heat said regions to a plastic state, whereby said bracket can be conformed to the desired contour of said mask without spring-back and without deforming said mask.

4. The bracket defined by claim 3 wherein said bracket is bow-tie-shaped.

5. The bracket defined by claim 3 wherein said arms have embossments extending between said welding projections for strengthening and stiffening said arms.

6. For use in the manufacture of a color cathode ray picture tube having a substantially rectangular face panel and a frameless, relatively thin and torsionally flexible metallic shadow mask mounted in precise relationship to said panel by corner-mounted suspension means, each suspension means including a relatively thick and inflexible metallic bracket for the embracement of and attachment to an associated corner of said mask, a method for conforming the contour of said bracket to the desired contour of said corner of said mask, comprising:

providing a bracket having at least one region of reduced cross-sectional area for increasing the electrical resistance of said region;

conducting an electrical current through said bracket, the magnitude of said current being effective to selectively electrically heat said region to a plastic state;

supporting said mask corner while pressing said bracket against said corner;

welding said bracket to said mask; and removing said electrical current to allow said region to become rigid;

whereby said bracket is conformed to the desired contour of said mask without spring-back and without deforming said mask.

7. For use in the manufacture of color television cathode ray picture tubes having a substantially rectangular face panel and a frameless, relatively thin and torsionally flexible metallic shadow mask with a rearwardly extending skirt mounted in precise adjacency to said panel by four corner-mounted suspension means, each suspension means including a relatively thick, inflexible metallic bracket having a planar central section and two arms for the embracement of and attachment to a corner of said skirt, said bracket including a pair of spaced-apart welding projections on each arm, a method of conforming said bracket to the desired contour of said mask skirt, comprising:

providing mask skirt-supporting means for supporting said skirt against inward deformation;

providing a bracket having at least one substantially rectangular perforated region adjacent to said central section which provides a reduction in cross-sectional area for increasing the electrical resistance of said region;

forcing the projections of said bracket toward said skirt;

routing an electrical current through said bracket to selectively resistively heat said region to cause said region to become plastic and said projections to make contact with said skirt;

welding said projections to said skirt;

removing said current to allow said region to become rigid;

whereby said brackets are conformed to the desired contours of said mask without exerting distortive pressure on said mask and without spring-back.

* * * * *